US005620093A

United States Patent [19]

Born

[11] Patent Number: 5,620,093

[45] Date of Patent: Apr. 15, 1997

[54] END WALL MADE FROM FORMABLE MATERIAL

[75] Inventor: Norbert Born, Blieskastel, Germany

[73] Assignee: Hoechst Aktiengesellschaft, Frankfurt am Main, Germany

[21] Appl. No.: 676,811

[22] Filed: Jul. 8, 1996

[30] Foreign Application Priority Data

Jul. 8, 1995 [DE] Germany ..... 195 24 954.2

[51] Int. Cl.[6] ..... B65D 85/671

[52] U.S. Cl. ..... 206/416; 206/821

[58] Field of Search ..... 206/389, 397, 206/408, 413, 414, 415, 416, 821

[56] References Cited

U.S. PATENT DOCUMENTS

| | | | |
|---|---|---|---|
| 4,877,133 | 10/1989 | Klenter et al. | 206/415 X |
| 4,884,690 | 12/1989 | Klenter et al. | 206/416 |
| 5,097,951 | 3/1992 | Pigott et al. | 206/413 X |
| 5,205,411 | 4/1993 | Born et al. | 206/391 |
| 5,344,013 | 9/1994 | Born et al. | 206/416 X |
| 5,431,282 | 7/1995 | Kremp et al. | 206/413 |

FOREIGN PATENT DOCUMENTS

| | | |
|---|---|---|
| 1991976 | 5/1968 | Germany . |
| 8550270 | 10/1985 | Germany . |

*Primary Examiner*—Jacob K. Ackun
*Attorney, Agent, or Firm*—Foley & Lardner

[57] ABSTRACT

An end wall of formable material for a reel, comprising:

a rectangular plate having first and second rounded corner faces, said first face facing the reel and having an annular cap, said second face facing outwardly from the reel and being stiffened by ribs, and a first, a second, a third, and a fourth side wall, said side walls extending around said plate at right angles to the first face thereof, said first and said third side walls being oppositely disposed and substantially smooth, said second side wall having grooves provided continuously over the length thereof, said grooves being perpendicular to the first face of the plate, and said fourth side wall having stacking bosses with central grooved portions on the surface thereof, and said fourth side wall further having recessed stacking pockets which alternate with said grooved stacking bosses.

12 Claims, 4 Drawing Sheets

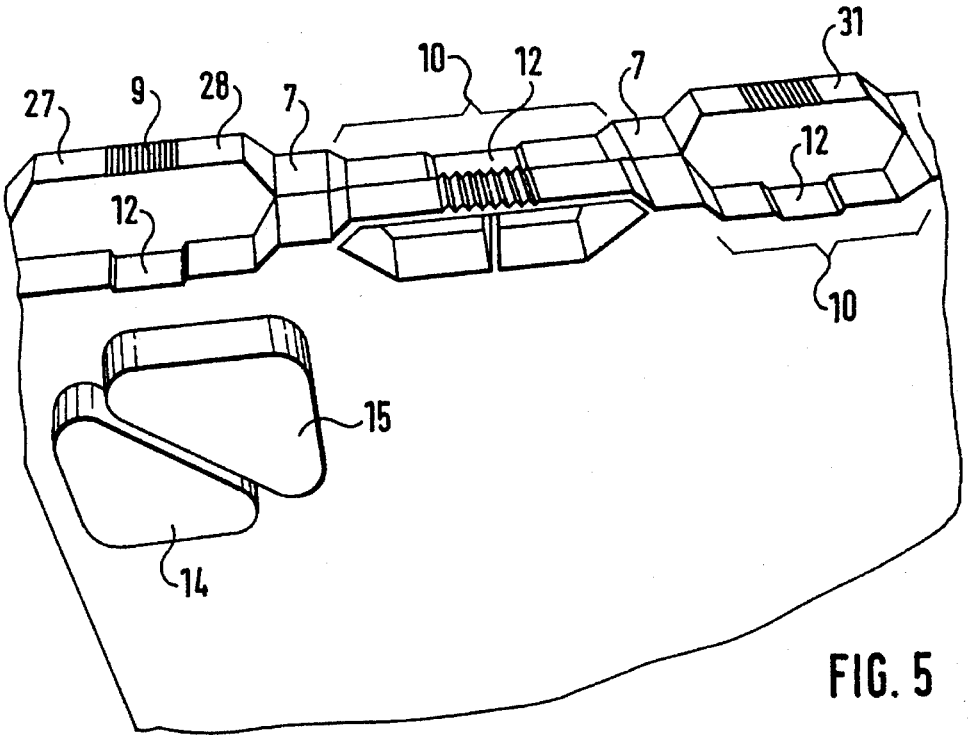
FIG. 5
FIG. 6
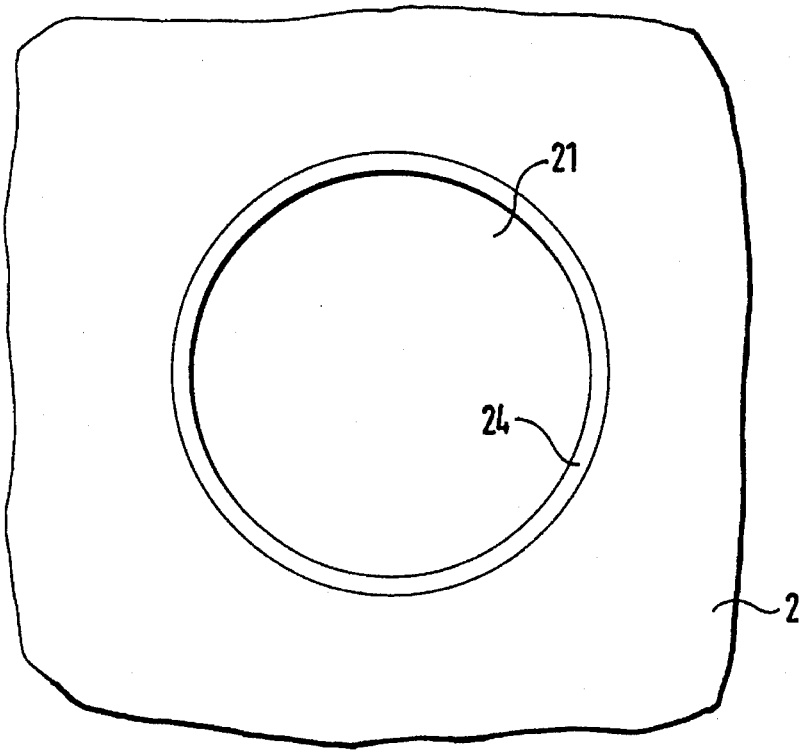

END WALL MADE FROM FORMABLE MATERIAL

BACKGROUND OF THE INVENTION

1. Field of the Invention

The invention relates to an end wall made from formable material for a reel.

2. Description of Related Art

A one-part end wall used with a second corresponding end wall forms an overall dimensionally stable packaging for a reel used for the packaging of winding material, such as plastic film, which is wound on winding tubes. End walls of this type are typically made from plastic or from another formable material. The two end walls are conventionally held together over the length of the reel by hooping bands.

DE-U 85 20 270 (DE '270) discloses an end wall having side walls or edge webs extending around the end wall. On the outer faces of the side walls there is provided a profiling consisting alternately of teeth and tooth spaces of equal length, width and height. Two groups of such profilings are located next to one another in the transverse direction and are arranged symmetrically to a plane bisecting the length of the side wall. As such, the profilings occupy only about half the length of a side wall. The front side of the end wall has a central integrated insertable tenon, but no retaining bosses are provided near or at the corners of the front side. However, in a practical embodiment four retaining bosses near the corners of the front side of the end wall may be provided. The end wall and further vertically aligned end walls can be stacked one above the other. However, the vertically aligned end walls cannot be stacked with the side walls next to one another. Furthermore, the ways in which the end walls according to DE '270 can be brought into engagement with one another or mutually retained are limited. This means that reels which are ready-packaged by using end walls of DE '270 cannot be stacked one above the other without further action, since the stability of stacking is not guaranteed.

DE-U 19 91 976 (DE '976) discloses a one-part end wall made from plastic, which consists of a four-cornered or quadratic plate stiffened by radial webs. Located in the middle of the end wall is an insertable tenon for the reel of winding material. The reel of DE '976 is equipped, for example, with holding prisms. The plate is enveloped by a strap, and on the outside of the strap, small prism-shaped strips are arranged. At the corners of the plate, the strap encloses four cup-shaped depressions projecting into a free hollow space between the winding material and packaging envelope which is open near an outer end face. The strap also possesses a stop strip having teeth.

EP-B 0 332 186 (EP '186) discloses an end wall having groups of profilings on the side walls and also having stacking bosses of different lengths and cross sections. Such an arrangement limits stacking pockets of different lengths and cross sections. To improve the mutual retention of end walls of a plurality of reels stacked one on and/or next to one another, the end walls of EP '186 are capable of engaging one another at each of their side walls, without a specific pre-selection of the alignment of the side walls having to be made.

The stacking pockets of EP '186 are designed and arranged complementarily to the stacking bosses. Thus, when vertically aligned end walls are stacked together laterally and/or stacked one above the other vertically, the stacking bosses and stacking pockets of a side wall of one end wall can be assembled without forming a gap between the stacking pockets and stacking bosses of each of the four side walls of a second end wall. The front side of the end wall of EP '186 is equipped with a central insertable tenon and four retaining bosses near the corners of the end wall.

EP-A-0,535,481 (EP '481) discloses an end wall which does not include stacking bosses and stacking pockets, but rather includes least one side wall of each end wall has a corrugation or grooving which extends over the length of the side wall which is interrupted by guide slots in the side wall. The rear side of the end wall of EP '481 is reinforced by webs. The single groove of the corrugation has the form of a prism cut through in the diagonal plane, the cross section of the groove being triangular.

EP-A-0,522,450 (EP '450) describes an end wall having a plate wherein at least one side wall of the plate is formed by a plane face. Arranged in the region of this plane face are projections which prevent a reel which is packaged by the end walls from slipping on the planks of a wooden transport pallet. The projections can have the form of geometrical figures narrowing upward.

EP-A-0,601,494 (EP '494) discloses an end wall made from injection molded material for a reel, wherein the end wall possesses a rectangular, particularly quadratic plate which has rounded corner faces. The front side of the end wall facing the reel has a central integrated insertable tenon and retaining bosses. The rear side of the end wall which faces away from the reel is stiffened by straight holding and annular ribs. The end wall is provided, on its side walls, with stacking bosses which limit the stacking pockets and which are formed complementarily to the stacking bosses. The front side of the plate is provided with an annular cap which surrounds the insertable tenon. The outside diameter of the annular cap is smaller than both the edge length of the end wall and the diameter of the reel. The inclusion of the annular cap prevents contact of the edge regions of the reel with the end wall, and as such, prevents disturbance of the edge region of the reel.

The costs of known end walls made from plastic for large formats are relatively high, particularly for reels having dimensions exceeding 800 mm×800 mm. Furthermore, large-format walls of this type typically have a high weight of approximately 80 to 90N. For reasons of cost, end walls previously used for large reels having diameters exceeding 700 mm have primarily been manufactured from chipboard. End walls of chipboard tend to be very heavy, i.e., they generally have a weight of about 130 to 160N, and, in the case of persons who have to handle these end walls for long periods, cause physical hardships.

Another disadvantage associated with the use of chipboard end walls is that, in contrast to end walls made from plastic, the return rate to manufacturers for end walls made from chipboard is very low. This is because the recipients of the end walls can use the chipboard material for other purposes after the reel is used. Moreover, the improper storage of end walls made from chipboard often causes damage to the end walls due to moisture, which in turn rules out reuse of the same.

SUMMARY OF THE INVENTION

An object of the present invention is to provide an improved end wall of formable material for a reel.

In accordance with the present invention, there has been provided an end wall of formable material for a reel, comprising a general rectangular plate having first and second rounded corner faces, said first face facing the reel and having an annular cap, said second face facing outwardly from the reel and being stiffened by ribs; and a first, a second, a third, and a fourth side wall, said side walls extending around said plate at right angles to the first face thereof, said first and said third side walls being oppositely disposed and substantially smooth, said second side wall having a plurality of grooves provided continuously over the length thereof, said grooves being perpendicular to the first face of the plate, and said fourth side wall having stacking bosses with central grooved portions on the surface thereof, and said fourth side wall further having recessed stacking pockets which alternate with said groove stacking bosses.

The invention is explained in more detail below by means of diagrammatically represented exemplary embodiments.

BRIEF DESCRIPTION OF THE DRAWINGS

In the drawings:

FIG. 5 is a perspective view of a cutout from the side wall with stacking pockets and with opposite grooving of the end wall according to the present invention; and FIG. 6 is a top view of a central insertion orifice of the end wall of an embodiment of the present invention.

DETAILED DESCRIPTION OF THE PREFERRED EMBODIMENTS

An end wall according to the present invention can be produced relatively cost-effectively and has a substantially lower weight than known end walls of the same format. An end wall of the present invention is substantially more bend-resistant and insensitive to breaks than comparable end walls and also increases the ability of reels packaged by end walls to be reliably stacked on wooden pallets.

Further, an end wall of the present invention includes two of the mutually opposite side walls which are designed smooth and plane (the first and third sidewalls), and the other two mutually opposite side walls (second and fourth sidewalls) are structured differently. The second side wall has a plurality of grooves provided continuously over the length of the side wall and perpendicular to the front side of the plate, while the fourth side wall also has a plurality of grooves on its surface. The fourth side wall preferably further includes stacking pockets without grooves which are complementary in form with grooved portions. The ungrooved sections preferably have slots.

In a preferred embodiment of the invention, stacking corners are preferably arranged on the front side of the plate near the rounded corners, each stacking corner including two projections. Each projection preferably has a triangular contour, and the mutually opposite longest sides of the two triangular projections together form a gap which extends obliquely relative to the contour edges of the front side. In particular, the gaps of the stacking corners preferably run along the plate diagonals.

In a further embodiment of the invention, the corners of the triangular projections are rounded and the gap has a width which corresponds to the thickness of the ribs provided on the rear side of a plate. This arrangement provides that, when two end walls are stacked one on the other, the radially extending ribs on the rear side of one plate snap into the gaps of the stacking corners of the other plate and the plate is thereby retained. A considerable weight reduction is achieved, inter alia, by the smooth design of the first and third side walls of the end wall and also by virtue of the omission of the central integrated insertable tenon, which is conventional in the known end walls, such that the weight is about 70 to 75N.

Figure 1:
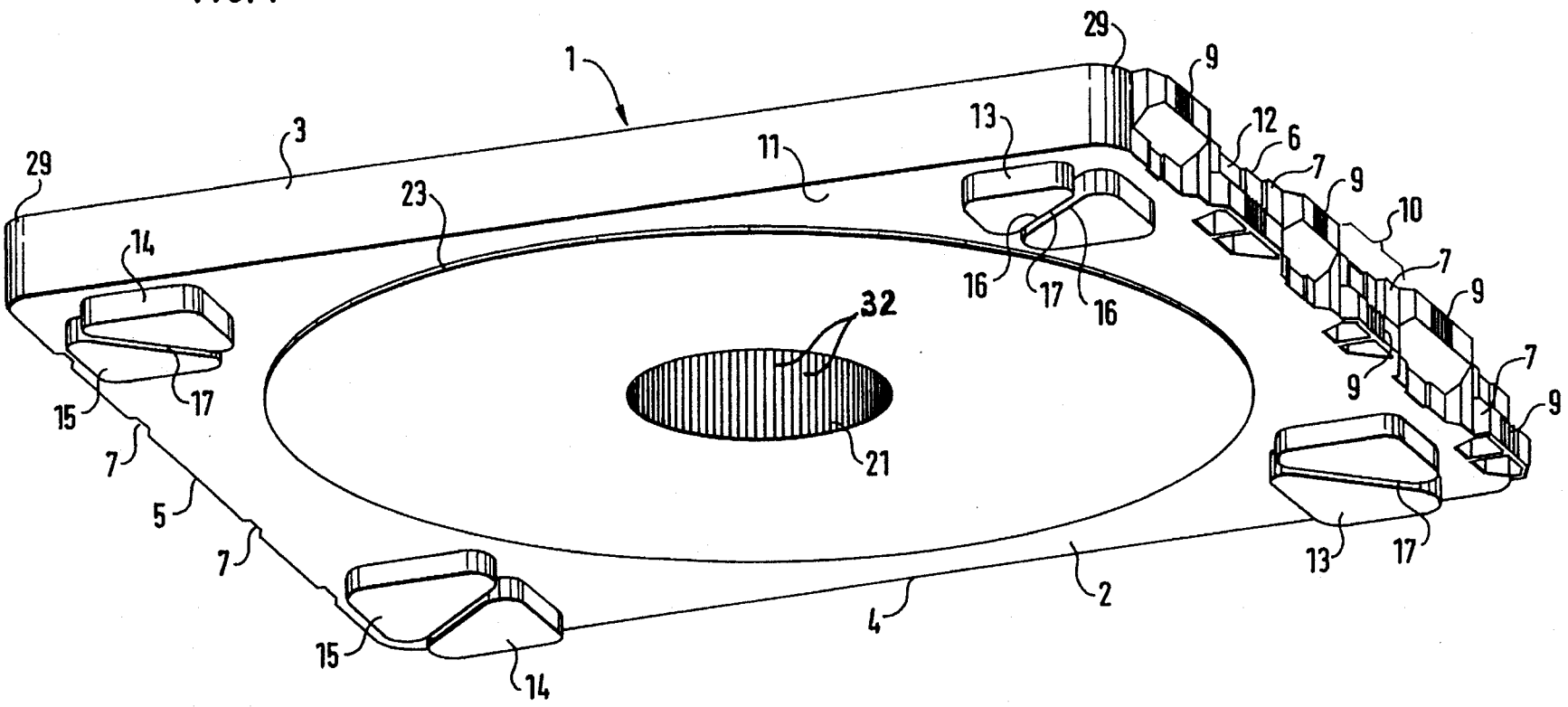
FIG. 1 is a perspective view in the direction of the front side of the end wall of an embodiment of the present invention.

As is evident from the perspective view in the direction of a front side 2 of an end wall 1 in FIG. 1, which is directed to a preferred embodiment of the present invention, two of the mutually opposite side walls 3 and 4 (previously referred to as the first and third side walls) are designed smooth and plane, whereas the other two mutually opposite side walls 5 and 6 (previously referred to as second and fourth sidewalls) are structured differently. The four side walls are connected to one another via rounded corners 29. The front side 2 preferably consists of a rectangular plate 11 which has an annular cap 23 and a central insertion orifice 21. The front side 2 of the end wall 1 faces a reel (not shown), while a rear side 20 (see FIG. 2) facing away from the reel faces outwards away from the reel. One side wall 5 is provided continuously with grooves 8 which extend perpendicularly to the front side 2 of the plate 11. Located on the other side wall 6 are a plurality of grooved sections 9 and stacking pockets 10 without grooves. The stacking pockets 10 have recesses 12 which are complementary in form to the grooves 9. The mutually opposite structured side walls 5 and 6 are preferably interrupted by guide slots 7 which receive hooping bands for the reel. The guide slots 7 extend perpendicularly to the longitudinal edges of the side walls 5 and 6. Near the rounded corners 29 on the front side 2 of the end wall 1, stacking corners 13 are preferably provided. The stacking corners 13 include two projections 14 and 15. Each of these projections has a triangular contour and the mutually opposite longest sides 16, 16 of these projections together form a gap 17 which extends obliquely relative to the contour edges of the front side 2. In particular, the gaps 17 of the stacking corners 13 preferably extend along the plate diagonals of the plate 11.

The outer dimensions of the end wall 1 are preferably in the range of 700 mm×700 to 1100 mm×1200 mm, and most preferably from 800 mm×860 to 800 mm×880 mm. The corners of the triangular projections 14, 15 are rounded, and the gap 17 has a width which corresponds to the thickness of the ribs 18, 19, on the rear side 20 of the plate 11. (See FIG. 2). A first embodiment according to FIG. 1 has an insertion orifice 21 with axially extending grooves 32 which extend in the longitudinal direction of the insertion orifice 21 at least over the height of an annular cap 23. Alternately, the grooves 32 may extend over the entire height of the insertion orifice 21.

Figure 2:
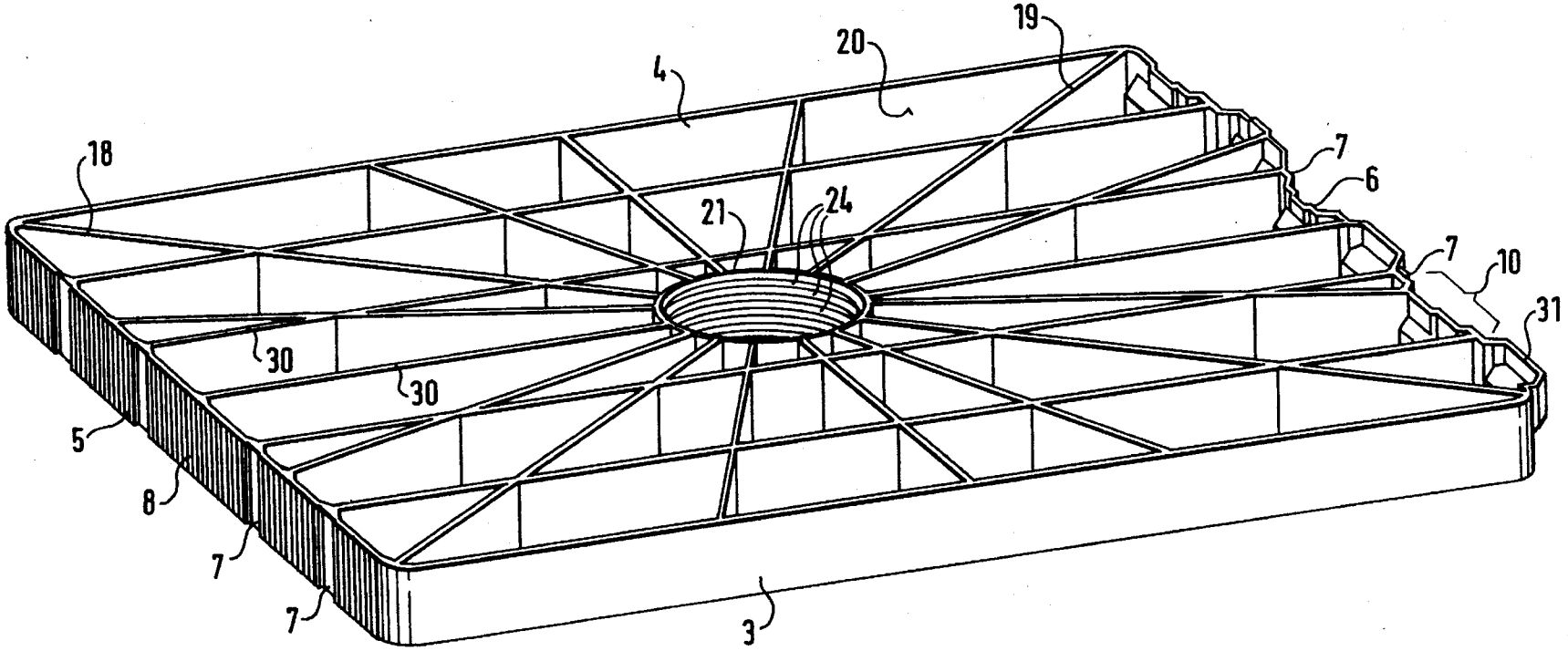
FIG. 2 is a perspective view in the direction of the rear side of the end wall of another embodiment of the present invention.

As shown in FIG. 2 which is a perspective view of another embodiment, the rear side 20 is reinforced by both radial ribs 18, 19 and, on the other hand, by longitudinal ribs 30 which run parallel to the smooth side walls 3, 4 of the plate 11. The left side wall 5 shown in FIG. 2 is provided with the continuous grooves 8, while the opposite side wall 6 has stacking pockets 10 and stacking bosses 31. From the insertion orifice 21, grooves 24 extending around the interior of the orifice can be seen on the rear side 20. The guide slots 7 for the hooping bands of a reel can be seen in the two structured side walls 5 and 6.

The annular cap has an outside diameter which is smaller than the diameter of the reel to be packaged and forms a gap between the end wall 1 and the outer edge of the reel, thereby preventing an unsetting of a cut edge of the reel. In contrast to the prior art, the end wall 1 preferably has no integrated insertable tenon which carries the reel, but instead, is used with a separate tenon or cylinder which is pushed through the insertion orifice 21 of the end wall into the hollow shaft of the reel. A tenon of this type preferably has elastic deformation under a load effect. In contrast to known end walls having rigid integrated insertable tenons, the end wall 1 according to the present invention, transmits substantially no shear forces to an inserted tenon. That is, if utilizing an integral insertable tenon shear forces can sometimes cause the tenon to break off. According to the present invention, the tenon (not shown), which is pushed into the insertion orifice 21, and the insertion orifice 21 each preferably have extending circumferentially grooves 24. (See infra, with reference to FIG. 6). The inclusion of grooves on the orifice and tenon substantially reduces the likelihood that the tenon will slip as a result of vibrations which may occur.

With reference to FIG. 2, the end wall 1 preferably possesses an essentially radial and vertical rib structure which serves for one-sided load absorption. The vertical rib structure is arranged such that, when the end wall 1 is in the operating position, the smooth side walls 3 and 4 and therefore also the ribs 30 extending parallel thereto, are aligned vertically. Preferably, the ribs are also continued in the stacking pockets 10. In contrast to the known end walls, the elimination of an annular and horizontal rib structure by the present invention provides substantial weight saving. The radial ribs 18 and 19 are supported in the corners 29 of the end wall 1, and thus serve for minimizing breakage in the event of any impact of the end wall 1, due to a fall, for example. The stacking corners 13 of the end wall are divided in order to receive the ribs of a second end wall stacked on it. The stacking corners are preferably kept flat and large in area and as such, are less at risk of breakage than known raised stacking or retaining bosses. The low overall height and the division of the stacking corners 13, (explained in more detail, infra), allow the end walls 1 to be laid directly on one another. The end walls of the present invention also will form a highly compact stack.

The stacking pockets 10 are provided only on the upper side wall 6 of the end wall 1, since preferably only two reels maximum are stacked one above the other. As already mentioned, the side walls 3 and 4 are designed smooth, since lateral toothing of end walls, particularly large reels, is not expedient due to, inter alia, the loading height of transport vehicles.

Figure 3:
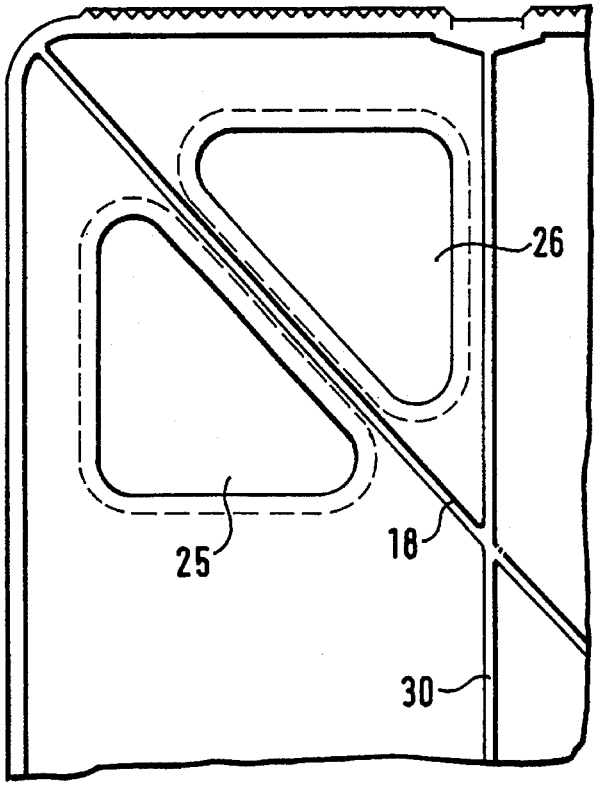
FIG. 3 is a detailed view of a cutout from the rear side near one corner of the end wall, according to the present invention.

FIG. 3 is a cutout from the rear side 20 of a preferred embodiment of the present invention, near one of the rounded corners 29 of the end wall 1. FIG. 3 shows that, on the rear side of the plate 11, there are preferably depressions 25, 26 which have a contour comparable in size to the projections 14, 15 of the stacking corner 13. When horizontally aligned end walls are stacked one on the other, the projections 14, 15 of the stacking corners 13 of one end wall do not substantially engage into the depressions 25, 26 of the end wall located above it due to the relatively small height of the projections. However, the radially extending ribs 18 and 19 on the rear side of one end wall will come into engagement with the gaps 17 of the stacking corners 13 and thereby provide good retention of the end walls lying one on the other.

Figure 4:
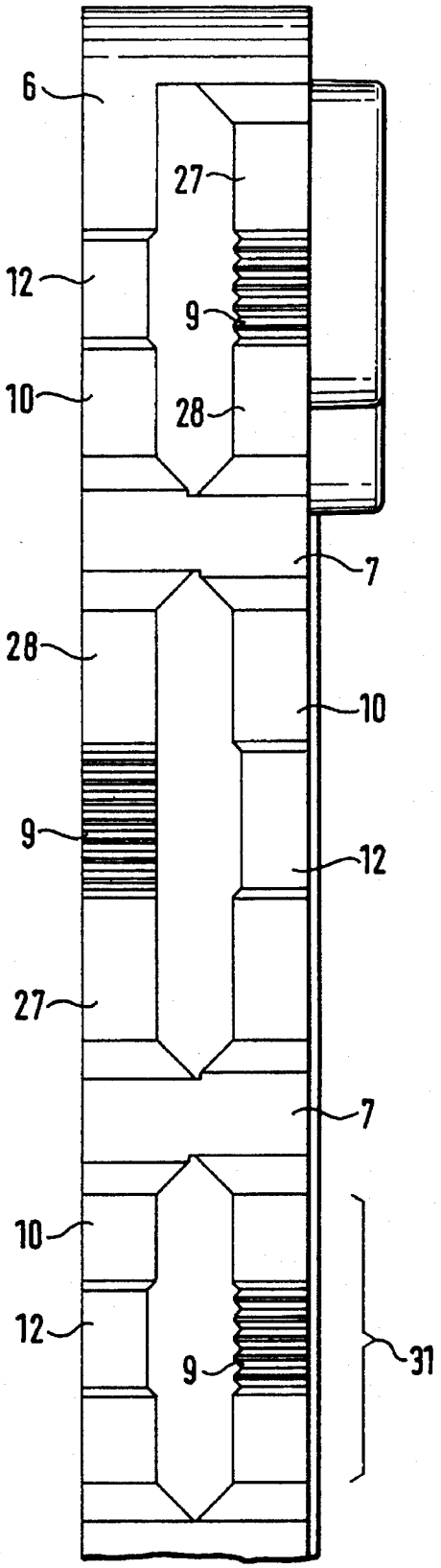
FIG. 4 is a top view of a side wall with stacking pockets and with opposite groovings of the end wall, according to the present invention.

The top view of the side wall 6 in FIG. 4 shows an embodiment wherein the portions of the side wall which are separated from one another by guide slots 7. Stacking bosses 31 and stacking pockets 10 are in each case located opposite one another. Each stacking boss 31 preferably possesses centrally arranged grooves 9, while smooth faces 27, 28 adjoin to the left and right of the grooves 9. Each stacking pocket 10 has a centrally arranged recess 12 which is located opposite to the grooves 9. Stacking pockets 10 and stacking bosses 31 preferably alternate with one another in the longitudinal direction of the side wall 6.

FIG. 5 shows a perspective view of a cutout from the side wall 6 having stacking bosses 31 and with stacking pockets 10. FIG. 6 shows a top view of the central insertion orifice 21 including a cylindrical portion which is provided along its circumferential face with a plurality of grooves 24 extending therearound. The grooves 24 extend at least over the height of the annular cap 23, but can also extend over the entire depth of the insertion orifice 21. The grooves 24 assist in providing non-slip vibration-free engagement of a correspondingly grooved tenon into the insertion orifice.

The stacking bosses 31, are preferably designed in such a way that their grooves 9 impart slip resistance to the end wall when the latter is placed onto a wooden pallet. When the end wall engages a second end wall placed on it, the grooves 9 are countersunk in the recesses 12 and thus do not substantially impede the stacking of the end walls on each other.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. An end wall of formable material for a reel, comprising:

a rectangular plate having first and second rounded corner faces, said first face facing the reel and having an annular cap, said second face facing outwardly from the reel and being stiffened by ribs, a first, a second, a third, and a fourth sidewall, said side walls extending around said plate at right angles to the first face thereof, said first and said third side walls being oppositely disposed and substantially smooth, said second side wall having a plurality of grooves provided continuously over the length thereof, said grooves being perpendicular to the first face of the plate, and said fourth side wall having stacking bosses with central grooved portions on the surface thereof, and said fourth side wall further having recessed stacking pockets which alternate with said grooved stacking bosses.

2. An end wall as claimed in claim 1, wherein said first face further includes stacking corners arranged near said rounded corners, each stacking corner comprising two triangular projections, wherein each projection has a longest side, and said longest sides of the two triangular projections are disposed in spaced relation with one another and form a gap therebetween which extends obliquely relative to said rounded corners of the first face.

3. An end wall as claimed in claim 2, wherein said gaps extend along the plate diagonals.

4. An end wall as claimed in claim 2, wherein said triangular projections include rounded corners, and wherein the gap has a width which corresponds to the thickness of the ribs on the second face of the plate.

5. An end wall as claimed in claim 1, wherein the outer dimensions thereof are in the range of 700 mm×700 mm to 1100 mm×1200 mm.

6. An end wall as claimed in claim 1, wherein said fourth side wall comprises, in addition to said stacking pockets, stacking bosses which alternate with said stacking pockets in the longitudinal direction of the fourth side wall, wherein each of said stacking bosses is provided in a central portion thereof, with a portion of said plurality of grooves, and wherein each of said stacking pockets is provided in a central portion thereof with a recess.

7. An end wall as claimed in claim 1, wherein at least a portion of the ribs on the second face of the plate extend radially to the first and third side walls, and a second portion of the ribs of the second face extend parallel to the first and third side walls of the plate.

8. An end wall as claimed in claim 1, further comprising a central insertion orifice having grooves which extend over an interior circumferential face of the orifice and wherein the grooves extend over the entire depth of the insertion orifice.

9. An end wall as claimed in claim 1, further comprising an annular cap, and an insertion orifice which is provided with grooves which extend at least over the height of the annular cap.

10. An end wall as claimed in claim 1, wherein the second and fourth side walls are interrupted by guide slots for accepting hooping bands of a reel, and wherein the guide slots extend perpendicularly to longitudinal edges of the side walls.

11. An end wall as claimed in claim 3, further comprising depressions in the second face of the plate which have a contour corresponding to the projections of the stacking corners.

12. An end wall as claimed in claim 6, wherein said stacking bosses and said stacking pockets are separated by guide slots.

* * * * *